US005589732A

United States Patent [19]

Okibayashi et al.

[11] Patent Number: 5,589,732

[45] Date of Patent: Dec. 31, 1996

[54] COLOR THIN FILM ELECTROLUMINESCENCE PANEL

[75] Inventors: Katsushi Okibayashi, Sakurai; Takashi Ogura, Nara; Masaru Yoshida, Nara-ken, all of Japan

[73] Assignee: Sharp Kabushiki Kaisha, Osaka, Japan

[21] Appl. No.: 378,869

[22] Filed: Jan. 24, 1995

Related U.S. Application Data

[63] Continuation of Ser. No. 4,067, Jan. 13, 1993, abandoned.

[30] Foreign Application Priority Data

Jan. 18, 1992 [JP] Japan ..... 4-006957

[51] Int. Cl.[6] ..... H01J 1/62

[52] U.S. Cl. ..... 313/506; 313/504; 313/509

[58] Field of Search ..... 313/504, 506, 313/509

[56] References Cited

U.S. PATENT DOCUMENTS 4,593,228 6/1986 Albrechtson et al. ..... 313/509
4,945,009 7/1990 Taguchi et al. ..... 313/506 X
5,189,405 2/1993 Yamashita et al. ..... 313/509 X
5,281,489 1/1994 Mori et al. ..... 313/507 X

OTHER PUBLICATIONS

"High–Brightness Multi–Color El Display Panels With Black–Matrix Filter" From SID 91 Digest (1991) by Katsushi Okibayashi et al.

"A 9–In.–Diagonal High–Contrast Multicolor Tfel Display" from SID 92 Digest (1992), by J. Haaranen et al.

*Primary Examiner*—Sandra L. O'Shea
*Assistant Examiner*—John Ning

[57] ABSTRACT

A color filter is laminated via a resin layer on an electroluminescence device. The resin layer includes silicone resin as its main ingredient while having a thickness of 2 to 100 μm. Thereby, possible color dislocation and reduction of the angle of visibility attributed to the gap between the electroluminescence device and the color filter are prevented. Furthermore, possible damage, dielectric breakdown, pixel dropout, and line defect due to the contact between the electroluminescence device and the color filter are reduced. A surface of the resin layer is changed in condition to make the resin layer have a lipophilic property to facilitate application of a material of the color filter thereto.

10 Claims, 2 Drawing Sheets

COLOR THIN FILM ELECTROLUMINESCENCE PANEL

This application is a continuation, of application Ser. No. 08/004,067 filed on Jan. 13, 1993, now abandoned.

BACKGROUND OF THE INVENTION

1. Field of the Invention

The present invention relates to color thin film electroluminescence (EL) panels, and more particularly to a color thin film EL panel for emitting multi-color light through a color filter made of organic materials.

2. Description of the Prior Art

Conventionally, a color thin film EL panel of the above-mentioned type has been constructed by arranging an EL device 20 formed on a glass substrate 11 and a color filter formed inside a sealing glass 19 opposite to each other and making-the glass substrate 11 adhere to the sealing glass 19 at their edges by means of an adhesive. The EL device 20 includes a back electrode 12, a first insulating layer 13 comprised of an $SiO_2$ layer 13*a* and an $Si_3N_4$ layer 13*b*, a phosphor layer 14 made of ZnS:Mn, a second insulating layer 15 comprised of an $Si_3N_4$ layer 15*a* and an $Al_2O_3$ layer 15*b*, and a transparent electrode 16. On the other hand, a color filter 18 is formed by combining in a mosaic pattern a green color filter part 18*a* and a red color filter part 18*b*, each of the filter parts 18*a* and 18*b* made of an organic material. The gap between the EL device 20 and the color filter 18 is made as narrow as possible so as not to cause color dislocation or reduction of the angle of visibility due to light leaking from adjacent pixels.

However, there are warping and waviness on the surfaces of the glass substrate 11 and the sealing glass 19 opposite to each other. In addition, there is nonuniformity in thickness of the adhesive for the adhesion between the glass substrate 11 and the sealing glass 19. Due to the above-mentioned facts, the gap between the EL device 20 and the color filter 18 has been conventionally increased, resulting in to result in the problems of color dislocation or reduction of the angle of visibility due to light leaking from adjacent pixels. Moreover, the EL device 20 and the color filter 18 are put in mechanical contact with each other in the adhesion stage, which possibly damages the parts. Furthermore, another problem which results when the EL device 20 and the color filter 18 are put in mechanical contact with each other after completion of a panel (in operation stage). This frequently cause dielectric breakdown resulting in pixel dropout or line defect.

SUMMARY OF THE INVENTION

The present invention has been developed with a view to substantially solving the above described disadvantages and has for its essential object to provide an improved color film EL panel capable of preventing possible color dislocation and reduction of the angle of visibility due to the gap between an EL device and a color filter as well as reducing possible damage, dielectric breakdown, pixel dropout, and line defect due to the contact between the EL device and the color filter.

In order to achieve the aforementioned object, the present invention provides a color film EL panel wherein light emitted from an EL device formed on a substrate travels outward through a color filter made of organic materials. The color film EL panel is characterized in that a resin layer is provided on the EL device and the color filter is laminated via the resin layer on the EL device.

It is preferred that the resin layer comprises silicone resin as its main ingredient.

It is also preferred that the resin layer is comprised of a laminate film formed by providing a silicone-modified epoxy resin layer on a silicone resin layer.

It is further preferred that the resin layer has a surface which is changed in condition to have a lipophilic property.

It is further preferred that the resin layer has a layer thickness of 2 μm to 100 μm.

The color filter is laminated via the resin layer on the EL device. Therefore the gap between the EL device and the color filter is made approximately constant by controlling the layer thickness of the resin layer to thereby prevent color dislocation and reduction of the angle of visibility due to increase of the gap. The color filter is laminated via the resin layer on the EL device in the panel production stage, and therefore the EL device is not put in mechanical contact with the color filter to avoid the possible damage of the parts. After completion of the panel, the resin layer operates as a buffer layer between the EL device and the color filter. Therefore, the possible pixel dropout and line defect due to dielectric breakdown caused by contact between the EL device and the color filter (referred to as "dielectric breakdown or the like" hereinafter) are reduced.

When the resin layer includes silicone resin as a main ingredient, the resin layer can exhibit an extremely high flexibility. For instance, the resin layer can take a hardness of 0 according to Standard A of JIS (Japanese Industrial Standards). In the above case, an enhanced buffer effect is effected to further reduce the possible occurrence of the dielectric breakdown or the like due to contact between the EL device and the color filter.

In the case where the resin layer is comprised of a laminate formed by providing a silicone-modified epoxy resin on a silicone resin, an improved wettability to the resin layer is assured when a color filter material (e.g., a material formed by dispersing a pigment and a photosensitive resin into a solvent containing 83% of propylene glycol methyl ether acetate and 17% of cyclohexane) is applied onto the resin layer. Therefore, the color filter is laminated on the resin layer without hindrance. When the resin layer surface has a hydrophilic property (e.g., silicone resin surface has a hydrophilic property because —OH group exists in the surface), the color filter material is repelled by the surface tension, and therefore the color filter cannot be laminated properly on the resin layer.

When the surface of the resin layer is changed in condition to have a lipophilic property, a good wettability to the resin layer can be assured when a color filter material is applied onto the resin layer in the same manner as described above. Therefore, the color filter is laminated on the resin layer without hindrance. In order to change the surface condition of the silicone resin to make it have a lipophilic property, it is required to effect ultraviolet exposure processing or apply a solvent such as HMDS (hexamethyl disilazine) on the silicone resin.

When the resin layer has a layer thickness of 2 μm to 100 μm, the resin layer can reduce the possible dielectric breakdown or the like of the panel completed and suppress the color dislocation and reduction of the angle of visibility below a permissible level. When the layer thickness of the resin layer is smaller than 2 μm, insufficient buffer operation is effected which results in slight reduction of the dielectric breakdown or the like. When the layer thickness of the resin layer exceeds 100 μm, the color dislocation and the reduction of the angle of visibility cannot be ignored.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The following describes in detail a color thin film EL panel in accordance with an embodiment of the present invention.

Figure 1:
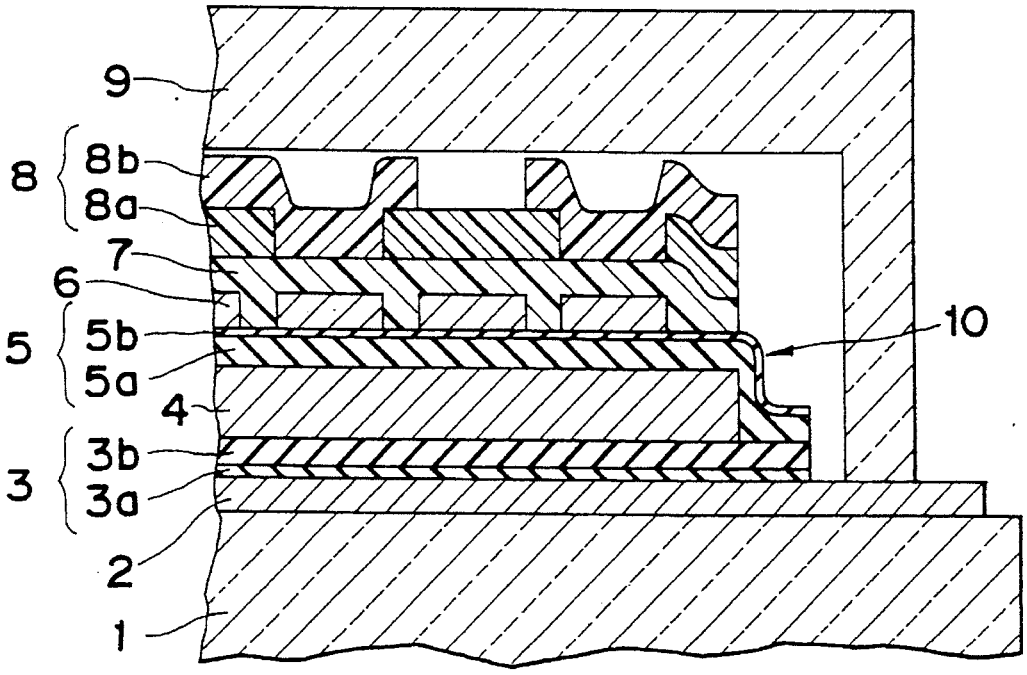
FIG. 1 is a sectional view showing the construction of a color thin film EL panel in accordance with an embodiment of the present invention.
Figure 2:
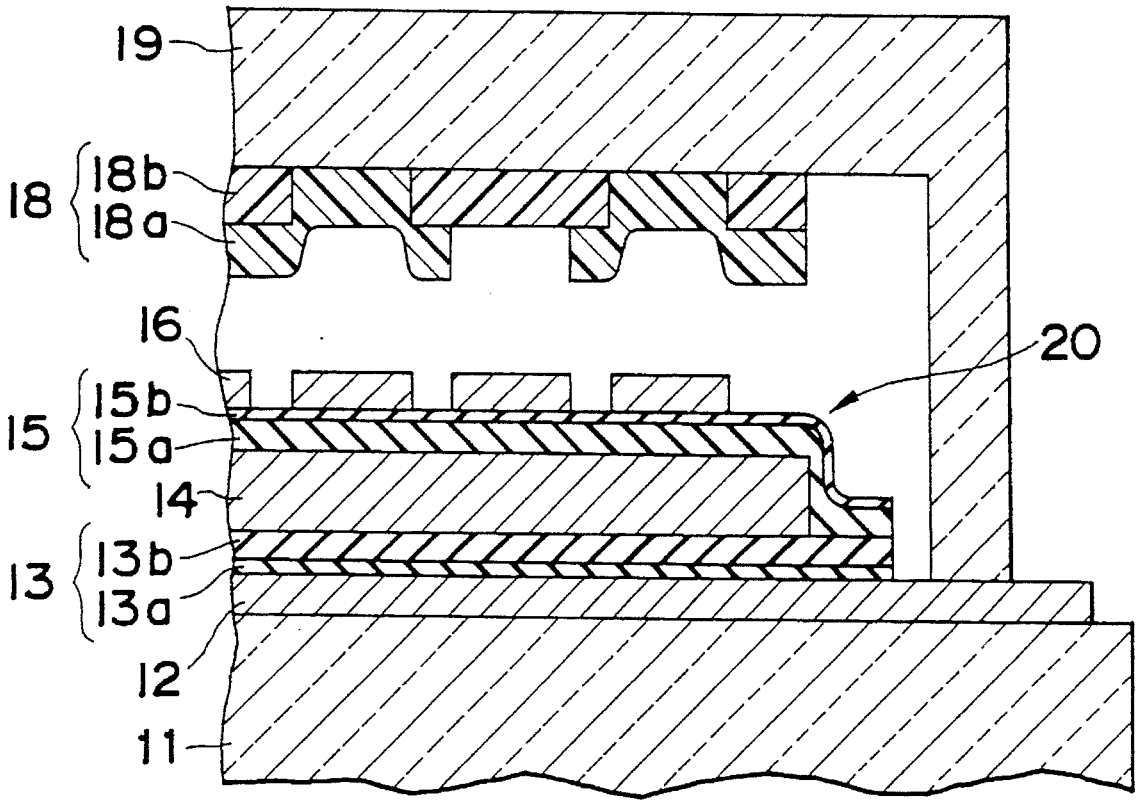
Fig. 2 PRIOR ART
FIG. 2 is a sectional view showing the construction of a conventional color thin film EL panel.

FIG. 1 shows a color thin film EL panel of an embodiment. The color thin film EL panel is constructed by laminating a color filter 8 via a resin layer 7 on an EL device 10 formed on a glass substrate 1 and covering the resulting laminate with a sealing glass 9. The EL device 10 includes a back electrode 2, a first insulating layer 3, a phosphor layer 4, a second insulating layer 5, and a transparent electrode 6 arranged in the above order on the substrate 1. The phosphor layer 4 is comprised of a ZnS:Mn film having a thickness of 1 μm formed by doping Mn which operates as a main electroluminescent substance into a base material ZnS. The first insulating layer 3 is comprised of an $Si_{O2}$ film 3*a* having a thickness of 300 to 800 Å and an $Si_3N_4$ film 3*b* having a thickness of 2000 to 3000Å, while the second insulating layer 5 is comprised of an $Si_3N_4$ film 5*a* having a thickness of 1000 to 2000Å and an $Al_2O_3$ film 5*b* having a thickness of 300 to 500Å. The back electrode 2 and the transparent electrode 6 are comprised of a metal Mo film and an ITO (indium tin oxide) film respectively. The resin layer 7 has a constant thickness of 5 to 10 μm and includes silicone resin which serves as its main ingredient exhibiting an excellent flexibility (having a hardness of 0 according to Standard A of JIS (Japanese Industrial Standards)). The color filter 8 is constructed by combining a green film 8*a* with a red film 8*b* in a mosaic pattern, where the green film 8*a* and the red film 8*b* overlap each other to form a so-called black matrix.

The color thin film EL panel is produced according to the following procedure. First, a metal Mo film is deposited on a substrate 1 in a sputtering method. The metal Mo film is processed in a prescribed stripe shape through a photolithography process to form a back electrode 2. Then an $SiO_2$ film 3*a* and an $Si_3N_4$ film 3*b* are deposited by the reactive sputtering method to form a first insulating layer 3. Then a phosphor layer 4 is formed by the chemical vapor deposition method (CVD method) or the electron beam evaporation method (EB method). (It is noted that a heat treatment is effected in the case of using the EB method). Then an $Si_3N_4$ film 5*a* and an $Al_2O_3$ film 5*b* are deposited by the reactive sputtering method to form a second insulating layer 5. Then an ITO film is deposited by the sputtering method. The ITO film is processed to have a stripe pattern with the back electrode 2 crossing at right angles through a photolithography process to thereby form a transparent electrode 6. Then silicone resin and silicone-modified epoxy resin are successively coated by the spin coating method to thereby form a resin layer 7. Then the surface condition of the resin layer 7 is changed from hydrophilic to lipophilic by being subjected to ultraviolet ray exposure so as to assure an improved wettability when coating a material of the color filter 8 in the next stage. Then a material of green film 8*a* constituting a part of the color filter 8 is coated. The material of the color filter 8 is formed by dispersing a pigment exhibiting a color of green or red and a photosensitive resin into a solvent containing 83% of propylene glycol methyl ether acetate and 17% of cyclohexane. Thereafter, a green film 8*a* is formed to have a specified pattern through a photolithography process. Subsequently, a material of red film 8*b* is coated to form a red film 8*b* in a specified pattern in the same manner as described above. Since the surface of the resin layer 7 has been changed., in condition to have a lipophilic property, the films 8*a* and 8*b* can be each coated to a specified thickness for stable film formation. Furthermore, enhanced adhesion between the resin layer 7 and each of the films 8*a* and 8*b* can be achieved. As described above, since the color filter 8 is laminated via the resin layer 7 on the EL device 10 in the panel production stage, there is no possibility of mechanical contact between the EL device 10 and the color filter 8, to resulting in no damage of the parts. Finally, after covering the color filter 8 with a sealing glass 9 and making the sealing glass 9 adhere to the glass substrate 1 at their edges, the gap space between the two is evacuated to complete the production of the panel.

According to the color thin film EL panel described as above, the color filter 8 is laminated on the EL device 10 via the resin layer 7 having a constant layer thickness of 5 to 10 μm, and therefore the gap between the EL device 10 and the color filter 8 can be made constant to thereby enable the prevention of color dislocation and reduction of the angle of visibility due to the increase of the gap. Furthermore, the resin layer 7 serves as a buffer layer between the EL device 10 and the color filter 8 in operation, with which the dielectric breakdown or the like due to contact between the EL device 10 and the color filter 8 can be reduced. The resin layer 7 includes silicone resin as its main ingredient, and therefore an enhanced buffer effect can be achieved to further reduce the dielectric breakdown or the like due to contact between the EL device 10 and the color filter 8.

When the layer thickness of the resin layer 7 is smaller than 2 μm, the resin layer insufficiently operates as a buffer layer to slightly reduce the dielectric breakdown or the like. When the layer thickness of the resin layer 7 exceeds 100 μm, the color dislocation and reduction of the angle of visibility cannot be ignored.

Although the surface of the resin layer 7 is subject to the ultraviolet exposure process to change the surface condition of the resin layer to make it have a lipophilic property in the above-mentioned panel production procedure, the method is not limitative. For instance, it is acceptable to apply a solvent such as HMDS (hexamethyl disilazine) on the silicone resin surface to change the condition of the —OH group existing in the surface of the silicone resin layer 7 to make it have a lipophilic property.

According to the color thin film EL panel of the present invention described as above, the color filter is laminated on the EL device via the resin layer, and therefore the color dislocation and reduction of the angle of visibility can be prevented by controlling the layer thickness of the resin layer. Furthermore, the color filter is laminated on the EL device via the resin layer in the panel production stage, and therefore the possible damage of the EL device and the color filter due to possible mechanical contact between the two can be eliminated. Furthermore, after completion of the panel, the resin layer operates as a buffer layer between the EL device and the color filter. Thus, the possible dielectric breakdown or the like due to contact of the parts in operation can be reduced.

When the aforementioned resin layer includes silicone resin as its main ingredient, the resin layer can exhibit an excellent flexibility to allow the buffer effect to be enhanced. Therefore, the possible dielectric breakdown or the like due to contact between the EL device and the color filter can be further reduced.

In the case where the resin layer is comprised of a laminate formed by providing a silicone-modified epoxy resin on a silicone resin, an improved wettability to the resin layer is assured when a color filter material (e.g., a material formed by dispersing a pigment and a photosensitive resin into a solvent containing 83% of propylene glycol methyl ether acetate and 17% of cyclohexane) is applied onto the resin layer. Therefore, the color filter can be laminated on the resin layer without hindrance.

When the surface of the resin layer is changed in condition to have a lipophilic property, a good wettability to the resin layer can be assured when the color filter material is coated on the resin layer in the same method as described above. Therefore, the color filter can be laminated on the resin layer without hindrance.

When the resin layer has a layer thickness of 2 μm to 100 μm, the resin layer can reduce the dielectric breakdown or the like of the panel completed and can suppress the color dislocation and the angle of visibility below a permissible level.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A color film electroluminescence panel, comprising:

an electroluminescence device;

buffer means, provided on the electroluminescence device, including silicon resin as a main ingredient thereof and having a thickness of at least 2 μm for reducing the possibility of dielectric breakdown of the color film electroluminescence panel by creating a buffer between the electroluminescence device and a color filter; and the color filter, laminated via the dielectric breakdown reduction means onto the electroluminescence device.

2. A color film electroluminescence panel as claimed in claim 1, wherein the buffer means includes a resin layer, which is comprised of a laminate film formed by providing a silicon-modified epoxy resin layer on a silicon resin layer.

3. A color film electroluminescence panel as claimed in claim 1, wherein the buffer means includes a resin layer, which is subjected to a process to change its surface from a hydrophilic property to a lipophilic property to thereby enable stable formation of the color filter.

4. A color film electroluminescence panel as claimed in claim 1, wherein the buffer means includes a resin layer, which has a constant layer thickness in the range of 2 μm to 100 μm to thereby ensure existence of a constant gap between the electroluminescence device and the color filter, to prevent color dislocation and to reduce the angle of visibility.

5. A color film electroluminescence panel as claimed in claim 2, wherein the buffer means includes a resin layer, which has a constant layer thickness in the range of 2 μm to 100 μm to thereby ensure existence of a constant gap between the electroluminescence device and the color filter, to prevent color dislocation and to reduce the angle of visibility.

6. A color film electroluminescence panel as claimed in claim 3, wherein the buffer means includes a resin layer, which has a constant layer thickness in the range of 2 μm to 100 μm to thereby ensure existence of a constant gap between the electroluminescence device and the color filter, to prevent color dislocation and to reduce the angle of visibility.

7. The color film electroluminescence panel of claim 1, wherein the buffer means has a layer thickness of 5 μm to 10 μm to reduce the possibility of color dislocation and to reduce the angle of visibility.

8. The color film electroluminescence panel of claim 2, wherein the buffer means includes a resin layer, which has a constant layer thickness of 5 μm to 10 μm to thereby ensure existence of a constant gap between the electroluminescence device and the color filter.

9. The color film electroluminescence panel of claim 3, wherein the buffer means includes a resin layer, which has a constant layer thickness of 5 μm to 10 μm to thereby ensure existence of a constant gap between the electroluminescence device and the color filter.

10. The color film electroluminescence panel of claim 7, wherein the buffer means has a hardness of zero according to Standard A of the Japanese Industrial Standards.

* * * * *